US012723339B2

(12) United States Patent
Dillon et al.

(10) Patent No.: US 12,723,339 B2
(45) Date of Patent: Sep. 1, 2026

(54) METHOD FOR DRAINING WASH FLUID FROM A TOP LOAD WASHING MACHINE APPLIANCE

(71) Applicant: Haier US Appliance Solutions, Inc., Wilmington, DE (US)

(72) Inventors: Nicholas Matthew Dillon, Louisville, KY (US); Cody Ewing, Floyds Knobs, IN (US); Robert Curtin, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 50 days.

(21) Appl. No.: 18/650,731

(22) Filed: Apr. 30, 2024

(65) Prior Publication Data

US 2025/0333893 A1 Oct. 30, 2025

(51) Int. Cl.
*D06F 33/42* (2020.01)
*D06F 23/04* (2006.01)
(Continued)

(52) U.S. Cl.
CPC ..... *D06F 33/42* (2020.02); *D06F 23/04* (2013.01); *D06F 33/40* (2020.02); *D06F 33/44* (2020.02); *D06F 34/06* (2020.02); *D06F 34/14* (2020.02); *D06F 39/085* (2013.01); *D06F 39/087* (2013.01); *D06F 2103/18* (2020.02); *D06F 2103/38* (2020.02); *D06F 2105/08* (2020.02); *D06F 2105/56* (2020.02)

(58) Field of Classification Search
CPC ..... D06F 33/40; D06F 33/42; D06F 33/48; D06F 34/06; D06F 34/14; D06F 34/16; D06F 34/22; D06F 39/083; D06F 39/085; D06F 39/087; D06F 2103/18; D06F 2103/26; D06F 2103/38; D06F 2105/08; D06F 2105/56
See application file for complete search history.

(56) References Cited

U.S. PATENT DOCUMENTS 7,757,324 B2 7/2010 Leidig et al.
8,245,343 B2 8/2012 Park et al.
(Continued)

FOREIGN PATENT DOCUMENTS

CN 105671860 B 6/2018
GB 2168388 A 6/1986
(Continued)

*Primary Examiner* — David G Cormier
(74) *Attorney, Agent, or Firm* — Dority & Manning, P.A.

(57) ABSTRACT

A washing machine appliance includes a wash tub positioned within a cabinet, a wash basket rotatably mounted within the wash tub and defining a wash chamber for receiving a load of clothes, a drain pump fluidly coupled to the wash tub for selectively draining wash fluid from the wash tub, a drain hose fluidly coupled to the drain pump for draining wash fluid from the wash tub, and a controller operably coupled to the drain pump. The controller is configured to operate the drain pump until the wash fluid is drained to a target wash fluid level, determine that a predetermined amount of time has passed since stopping operation of the drain pump, and operating the drain pump after the predetermined amount of time has passed to drain an excess amount of the wash fluid from the wash tub.

16 Claims, 4 Drawing Sheets

(51) Int. Cl.

| | |
|---|---|
| ***D06F 33/40*** | (2020.01) |
| ***D06F 33/44*** | (2020.01) |
| ***D06F 34/06*** | (2020.01) |
| ***D06F 34/14*** | (2020.01) |
| ***D06F 39/08*** | (2006.01) |
| *D06F 103/18* | (2020.01) |
| *D06F 103/38* | (2020.01) |
| *D06F 105/08* | (2020.01) |
| *D06F 105/56* | (2020.01) |

(56) References Cited

U.S. PATENT DOCUMENTS

| | | | |
|---|---|---|---|
| 8,505,139 | B2 | 8/2013 | Vanhazebrouck et al. |
| 10,030,330 | B2 | 7/2018 | Leibman |
| 10,066,333 | B2 | 9/2018 | Kim et al. |
| 10,494,750 | B2 | 12/2019 | Lee et al. |
| 10,697,103 | B2 | 6/2020 | Heo et al. |
| 10,801,156 | B2 | 10/2020 | Pollett et al. |
| 11,306,425 | B2 | 4/2022 | Lee et al. |
| 11,326,296 | B2 | 5/2022 | Lee et al. |
| 11,530,505 | B2 | 12/2022 | Scheckelhoff et al. |
| 2010/0000267 | A1 | 1/2010 | Leidig et al. |
| 2015/0240406 | A1* | 8/2015 | Kim ..... D06F 37/225 34/427 |
| 2016/0083890 | A1 | 3/2016 | Shin et al. |
| 2018/0002857 | A1* | 1/2018 | Hombroek ..... D06F 35/005 |
| 2020/0217002 | A1 | 7/2020 | Damtew |
| 2022/0220656 | A1 | 7/2022 | Lee et al. |
| 2022/0259791 | A1 | 8/2022 | Lee et al. |

FOREIGN PATENT DOCUMENTS

| | | | |
|---|---|---|---|
| JP | 2011224227 | A | 11/2011 |
| WO | WO2018076082 | A1 | 5/2018 |
| WO | WO2023280231 | A1 | 1/2023 |
| WO | WO2023033368 | A1 | 3/2023 |

* cited by examiner

METHOD FOR DRAINING WASH FLUID FROM A TOP LOAD WASHING MACHINE APPLIANCE

FIELD OF THE INVENTION

The present subject matter relates generally to top load washing machine appliances, or more specifically, to methods for draining wash fluid from a top load washing machine appliance to compensate for excess fluid within the appliance.

BACKGROUND OF THE INVENTION

Washing machine appliances generally include a cabinet which supports a tub for containing water or wash fluid, e.g., water and detergent, bleach and/or other wash additives. A basket is rotatably mounted within the tub and defines a wash chamber for receipt of articles for washing. During normal operation of such washing machine appliances, the wash fluid is directed into the tub and onto articles within the wash chamber of the basket. The basket or an agitation element can rotate at various speeds to agitate articles within the wash chamber, to wring wash fluid from articles within the wash chamber, etc. During a spin or drain cycle, a drain assembly may operate to discharge water from within sump.

In some cases, an uneven distribution of weight during a spin cycle in a top load washing machine appliance may cause excessive displacement of the tub and basket. In minor cases, a slight imbalance may cause vibration or noise. In extreme cases, the tub may contact the cabinet of the appliance. These impacts or "cabinet strikes" are noisy and can cause the washing machine appliance to "walk" on the floor. Over time, the impacts can cause damage to the appliance. Such uneven weight distributions during the spin cycle may be caused by excess wash fluid remaining within the tub after the drain cycle is completed.

Accordingly, a washing machine appliance having improved wash fluid draining would be desirable. More specifically, a washing machine appliance with wash fluid draining to remove excess fluid from the washing machine appliance would be particularly beneficial.

BRIEF DESCRIPTION OF THE INVENTION

Advantages of the invention will be set forth in part in the following description, or may be apparent from the description, or may be learned through practice of the invention.

In one exemplary aspect, a washing machine appliance defining a vertical direction, a lateral direction, and a transverse direction is disclosed, the washing machine appliance includes a wash tub positioned within a cabinet, a wash basket rotatably mounted within the wash tub and defining a wash chamber configured for receiving a load of clothes, a drain pump fluidly coupled to the wash tub for selectively draining wash fluid from the wash tub, a drain hose fluidly coupled to the drain pump for draining the wash fluid from the wash tub, and a controller operably coupled to the drain pump. The controller is configured to operate the drain pump until the wash fluid is drained to a target wash fluid level, after operating the drain pump, determine that a predetermined amount of time has passed since stopping the operation of the drain pump, and operating the drain pump after the predetermined amount of time has passed to drain an excess amount of the wash fluid from the wash tub.

In another exemplary aspect, a method for draining wash fluid from a washing machine appliance is disclosed of operating a washing machine appliance is disclosed, the washing machine appliance includes a wash tub positioned within a cabinet, a wash basket rotatably mounted within the wash tub and defining a wash chamber configured for receiving a load of clothes, a drain pump fluidly coupled to the wash tub for selectively draining wash fluid from the wash tub, and a drain hose fluidly coupled to the drain pump for draining the wash fluid from the wash tub. The method includes operating, with a controller, the drain pump until the wash fluid is drained to a target wash fluid level, after operating the drain pump, determining, with the controller, that a predetermined amount of time has passed since stopping the operation of the drain pump, and operating, with the controller, the drain pump after the predetermined amount of time has passed to drain an excess amount of the wash fluid from the wash tub.

In another exemplary aspect, a method of operating a spin cycle of a washing machine appliance is disclosed. The method comprising initiating the spin cycle, operating a motor to accelerate a wash basket in a wash tub to a first rotational speed, the wash tub containing a remaining portion of a total amount of wash fluid, wherein a bottom wall of the wash basket is partially submerged in the remaining portion, and operating a drain pump to drain the remaining portion of wash fluid in the wash tub. The method further comprises continuing operation of the motor to accelerate the rotational speed of the wash basket from the first rotational speed to a first dwell speed, operating the motor to accelerate the rotational speed of the wash basket from the first dwell speed to a second dwell speed, operating the motor to accelerate the rotational speed of the wash basket from the second dwell speed to a third dwell speed, and operating the drain pump to drain the remaining portion of wash fluid from the wash tub during at least one of the first dwell speed, the second dwell speed, or the third dwell speed.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
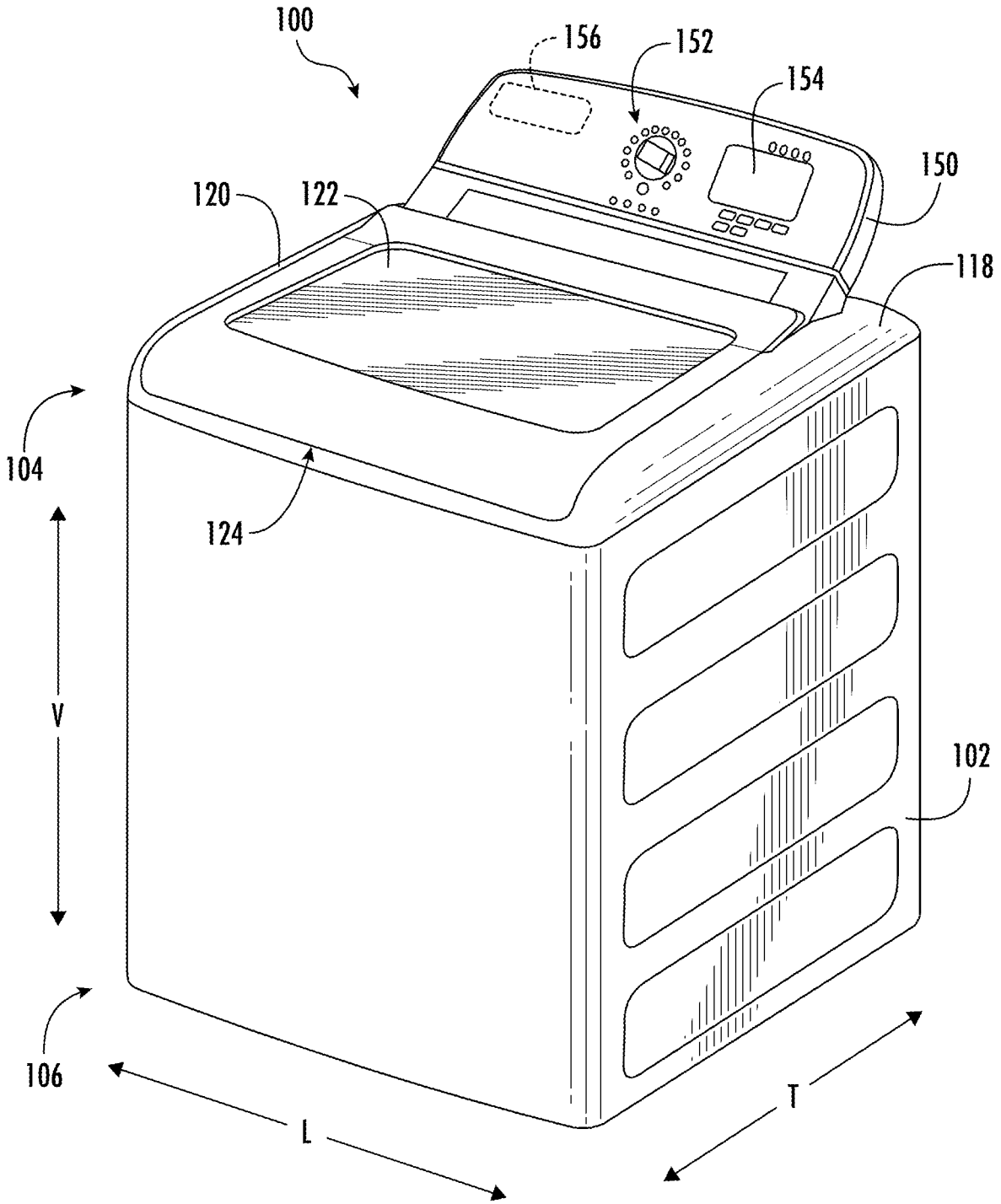
FIG. 1 provides a perspective view of an exemplary washing machine appliance according to an exemplary embodiment of the present subject matter with a lid of the washing machine appliance shown in a closed position.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). The term "at least one of" in the context of, e.g., "at least one of A, B, and C" refers to only A, only B, only C, or any combination of A, B, and C. In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "clothing," "articles," and the like may include but need not be limited to fabrics, textiles, garments, linens, papers, or other items which may be cleaned, dried, and/or otherwise treated in a laundry appliance. Furthermore, the terms "load" or "laundry load" refers to the combination of clothing that may be washed together in a washing machine or dried together in a dryer appliance and may include a mixture of different or similar articles of clothing of different or similar types and kinds of fabrics, textiles, garments and linens within a particular laundering process.

Figure 2:
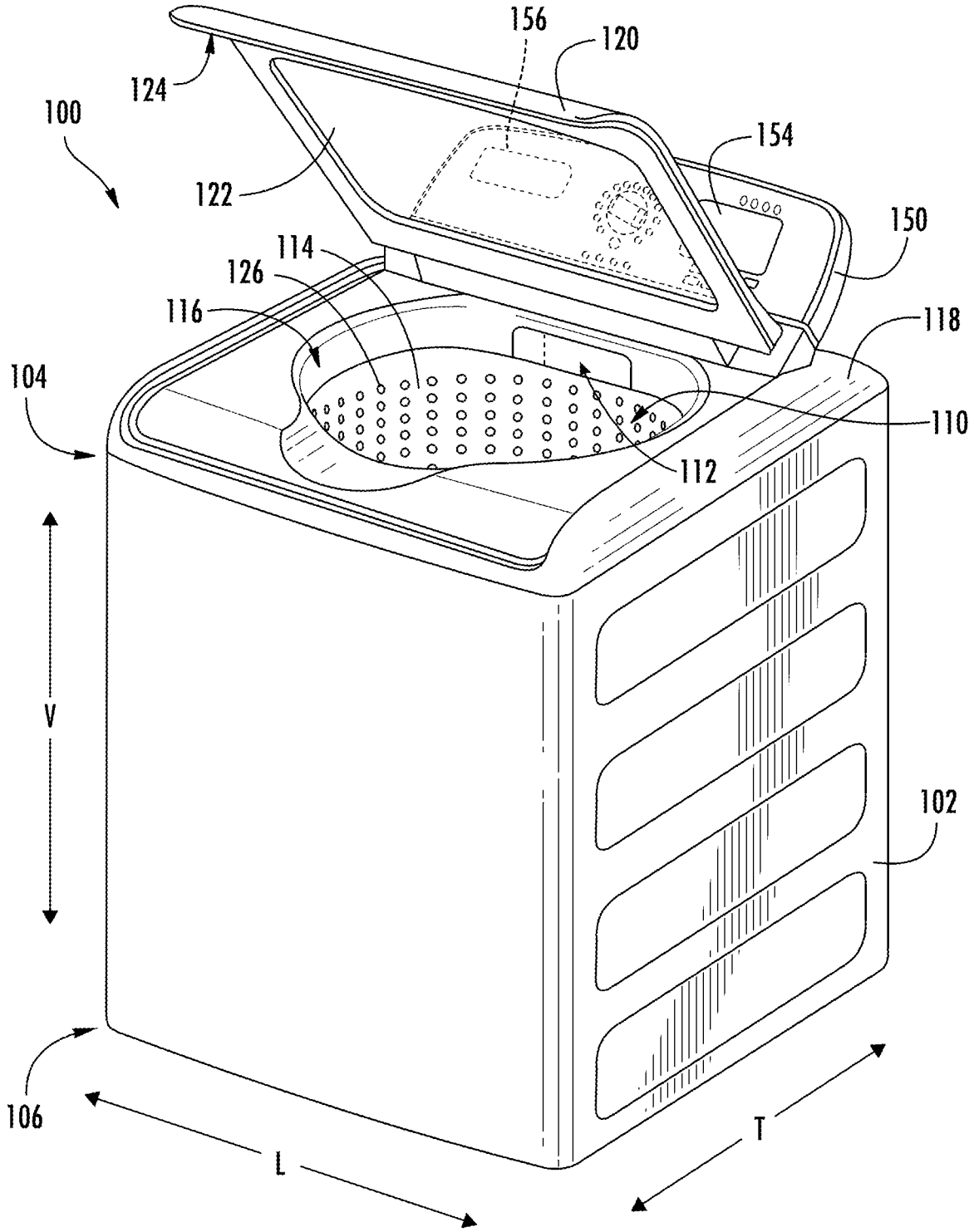
FIG. 2 provides a perspective view of the exemplary washing machine appliance of FIG. 1 with the lid of the washing machine appliance shown in an open position.
Figure 3:
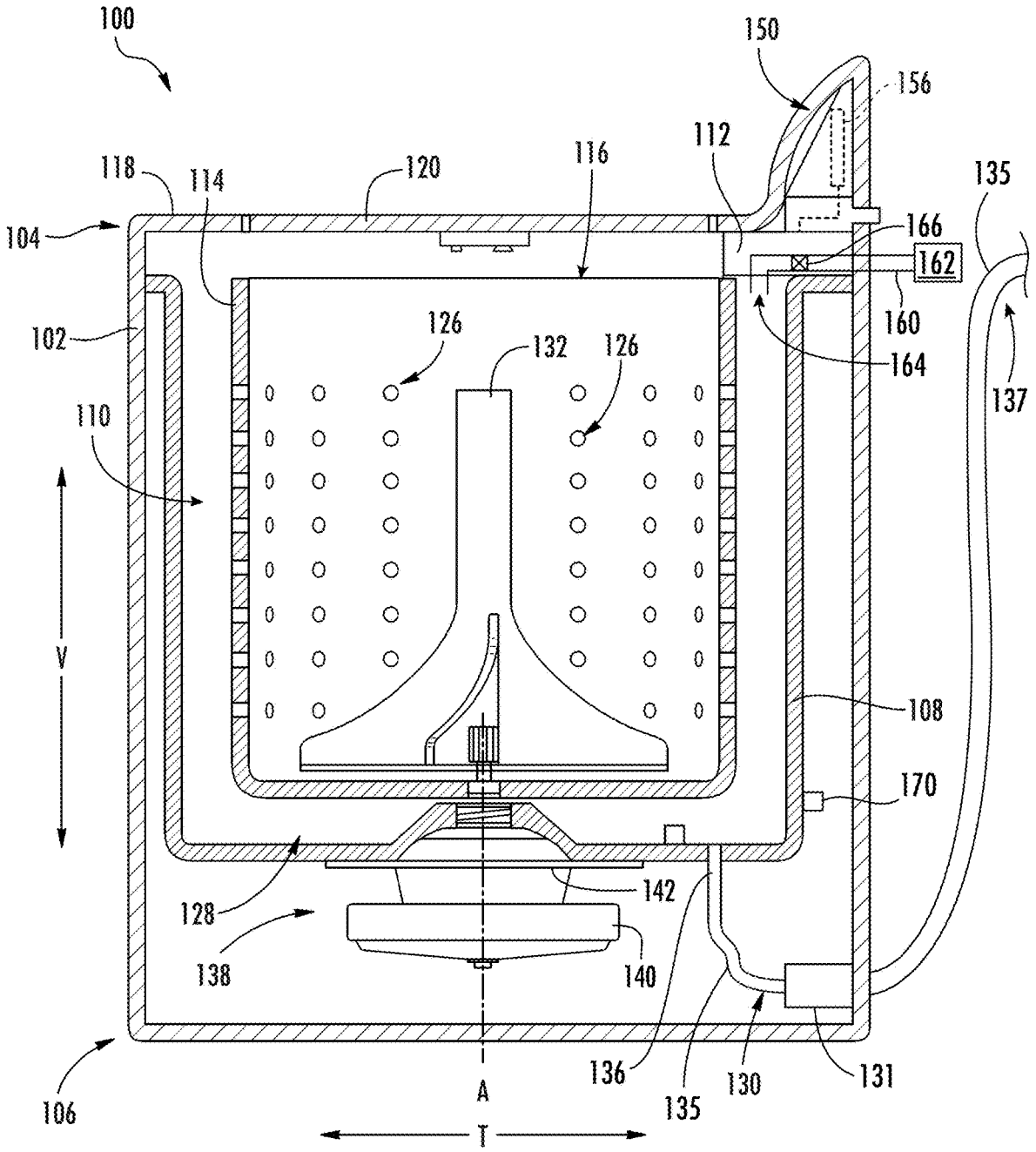
FIG. 3 provides a side cross-sectional view of the exemplary washing machine appliance of FIG. 1.

Referring now to the figures, FIGS. 1 through 3 illustrate an exemplary embodiment of a vertical axis washing machine appliance 100. Specifically, FIGS. 1 and 2 illustrate perspective views of washing machine appliance 100 with the lid in a closed and an open position, respectively. FIG. 3 provides a side cross-sectional view of washing machine appliance 100. As illustrated, washing machine appliance 100 generally defines a vertical direction V, a lateral direction L, and a transverse direction T, each of which is mutually perpendicular, such that an orthogonal coordinate system is generally defined.

While described in the context of a specific embodiment of vertical axis washing machine appliance 100, it should be appreciated that vertical axis washing machine appliance 100 is provided by way of example only. It will be understood that aspects of the present subject matter may be used in any other suitable washing machine appliance, such as a horizontal axis washing machine appliance. Indeed, modifications and variations may be made to washing machine appliance 100, including different configurations, different appearances, and/or different features while remaining within the scope of the present subject matter.

Washing machine appliance 100 includes a cabinet 102 that extends between a top 104 and a bottom 106 along the vertical direction V, between a first side (left) 103 and a second side (right) 105 along the lateral direction, and between a front 107 and a rear 109 along the transverse direction T. As best illustrated in FIG. 3, a wash tub 108 is positioned within cabinet 102, the wash tub 108 defining a wash chamber 110, and is generally configured for retaining wash fluids during an operating cycle. Washing machine appliance 100 further includes a primary dispenser 112 (FIG. 2) for dispensing wash fluid into wash tub 108. The term "wash fluid" refers to a liquid used for washing and/or rinsing articles during an operating cycle and may include any combination of water, detergent, fabric softener, bleach, and other wash additives or treatments.

Further, washing machine appliance 100 includes a wash basket 114 that is positioned within wash tub 108 and generally defines an opening 116 for receipt of articles for washing. More specifically, wash basket 114 is rotatably mounted within wash tub 108 such that it is rotatable about an axis of rotation A. According to the illustrated embodiment, the axis of rotation A is substantially parallel to the vertical direction V. In this regard, washing machine appliance 100 is generally referred to as a "vertical axis" or "top load" washing machine appliance 100. However, it should be appreciated that aspects of the present subject matter may be used within the context of a horizontal axis or front load washing machine appliance as well.

As illustrated, cabinet 102 of washing machine appliance 100 has a top panel 118 which defines a top panel opening (FIG. 2) that coincides with opening 116 of wash basket 114 to permit a user access to wash basket 114. Washing machine appliance 100 further includes a door 120 which is rotatably mounted to top panel 118 to permit selective access to wash basket 114 through opening 116. In particular, door 120 selectively rotates between the closed position (FIGS. 1, 3) and the open position (FIG. 2). In the closed position, door 120 inhibits access to wash basket 114. Conversely, in the open position, a user can access wash basket 114. A window 122 in door 120 permits viewing of wash basket 114 when door 120 is in the closed position, e.g., during operation of washing machine appliance 100. Door 120 also includes a handle 124 that may facilitate opening and closing door 120 e.g., a user may pull and/or lift when opening and closing door 120. Further, although door 120 is illustrated as mounted to top panel 118, door 120 may alternatively be mounted to cabinet 102 or any other suitable support.

As best illustrated in FIGS. 2 and 3, wash basket 114 further defines a plurality of perforations 126 to facilitate fluid communication between an interior of wash basket 114 and wash tub 108. In this regard, wash basket 114 is spaced apart from wash tub 108 to define a space for wash fluid to escape wash chamber 110. During a spin cycle, wash fluid within articles of clothing and within wash chamber 110 is urged through perforations 126 and may collect in a sump 128 defined by wash tub 108.

The washing machine appliance 100 further includes a drain pump assembly 130 (FIG. 3) that is located beneath wash tub 108 and wash basket 114 for gravity assisted flow when draining wash tub 108. The drain pump assembly 130 may include a drain pump 131 and associated tubing or drain hose 135 to couple the drain pump 131 to the wash tub 108 and to the external environment, for example an external drain (not shown). A first end 136 of the drain hose 135 may fluidly couple pump assembly 130 to the wash tub 108, for example at sump 128, to facilitate removal of wash fluid. A second end 137 of the drain hose 135 may be fluidly coupled to an external drain (not shown) to accept effluent from the wash tub 108. The drain pump 131 may be operably coupled to a controller 156, which will be described below, to accept operating instructions (for example on or off commands or speed control) to drain the wash fluid from wash tub 108 and provide feedback to the controller 156.

An impeller or agitation element 132 (FIG. 3), such as a vane agitator, impeller, auger, oscillatory basket mechanism, or some combination thereof is disposed in wash basket 114 to impart an oscillatory motion to laundry articles and liquid in wash basket 114. More specifically, agitation element 132 extends into wash basket 114 and assists agitation of articles disposed within wash basket 114 during operation of washing machine appliance 100 to, e.g., facilitate improved cleaning. In different embodiments, agitation element 132 includes a single action element (i.e., oscillatory only), a double action element (oscillatory movement at one end, single direction rotation at the other end) or a triple action element (oscillatory movement plus single direction rotation at one end, single direction rotation at the other end). As illustrated in FIG. 3, agitation element 132 and wash basket 114 are oriented to rotate about axis of rotation A (which is substantially parallel to vertical direction V).

As best illustrated in FIG. 3, washing machine appliance 100 includes a drive assembly or motor assembly 138 in mechanical communication with wash basket 114 and to selectively rotate wash basket 114 (e.g., during an agitation or a rinse cycle of washing machine appliance 100). In addition, motor assembly 138 may also be in mechanical communication with agitation element 132. In this manner, motor assembly 138 may be configured for selectively rotating or oscillating wash basket 114 and/or agitation element 132 during various operating cycles of washing machine appliance 100.

Motor assembly 138 may generally include one or more of a drive motor 140 and a transmission assembly 142, for example a clutch assembly for engaging and disengaging wash basket 114 and/or agitation element 132 with the drive motor 140. According to the illustrated embodiment, the drive motor 140 may be a brushless DC electric motor, e.g., a pancake motor. However, according to alternative embodiments, drive motor 140 may be any other suitable type or configuration of motor. For example, drive motor 140 may be an AC motor, an induction motor, a permanent magnet synchronous motor, or any other suitable type of motor. In addition, motor assembly 138 may include any other suitable number, types, and configurations of support bearings or drive mechanisms.

Referring still to FIGS. 1 through 3, a control panel 150 with at least one input selector 152 (FIG. 1) extends from top panel 118. Control panel 150 and input selector 152 collectively form a user interface input for operator selection of machine cycles and features. A display 154 of control panel 150 indicates selected features, operation mode, a countdown timer, and/or other items of interest to appliance users regarding operation.

Operation of washing machine appliance 100 is controlled by the controller 156 that is operatively coupled (e.g., electrically coupled or connected) to control panel 150 for user manipulation to select washing machine cycles and features. In response to user manipulation of the user input selector 152, controller 156 operates the various components of washing machine appliance 100 to execute selected machine cycles and features. According to an exemplary embodiment, controller 156 may include a memory and microprocessor, such as a general or special purpose microprocessor operable to execute programming instructions or micro-control code associated with methods described herein. Alternatively, controller 156 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 150 and other components of washing machine appliance 100 may be in communication with controller 156 via one or more signal lines or shared communication busses.

During operation of washing machine appliance 100, laundry items are loaded into wash basket 114 through opening 116, and washing operation is initiated through operator manipulation of input selectors 152. Wash basket 114 is filled with water and detergent and/or other fluid additives via primary dispenser 112. One or more valves can be controlled by washing machine appliance 100 to provide for filling wash tub 108 and wash basket 114 to the appropriate level for the amount of articles being washed and/or rinsed. By way of example for a wash mode, once wash basket 114 is properly filled with fluid, the contents of wash basket 114 can be agitated (e.g., with agitation element 132 as discussed previously) for washing of laundry items in wash basket 114.

More specifically, referring again to FIG. 3, a water fill process will be described according to an exemplary embodiment. As illustrated, washing machine appliance 100 includes a water supply conduit 160 that provides fluid communication between a water supply source 162 (such as a municipal water supply) and a discharge nozzle 164 for directing a flow of water into wash chamber 110. In addition, washing machine appliance 100 includes a water fill valve or water control valve 166 which is operably coupled to water supply conduit 160 and communicatively coupled to controller 156. In this manner, controller 156 may regulate the operation of water control valve 166 to regulate the amount of water within wash tub 108.

Although water supply conduit 160, water supply source 162, discharge nozzle 164, and water control valve 166 are all described and illustrated herein in the singular form, it should be appreciated that these terms may be used herein generally to describe a supply plumbing for providing hot and/or cold water into wash chamber 110. In this regard, water supply conduit 160 may include separate conduits for receiving hot and cold water, respectively. Similarly, water supply source 162 may include both hot- and cold-water supplies regulated by dedicated valves.

In addition, washing machine appliance 100 may include one or more pressure sensors 170 for generating a signal indicative of a wash fluid level within the wash tub 108. For example, pressure sensor 170 may be operably coupled to a side of tub 108 for detecting the amount of the wash fluid within the wash tub 108. Additionally, pressure sensor 170 may be operably coupled to the controller 156. As such, the controller 156 may receive the signal from the pressure sensor 170 corresponding to the amount of the wash fluid within the wash tub 108 detected by the pressure sensor 170 to determine the level or height of the wash fluid within the wash tub 108. To maintain a proper amount of wash fluid in the tub 108, the controller may selectively operate the drain pump 131 in response to the signal from the pressure sensor 170.

After wash tub 108 is filled and the agitation phase of the wash cycle is completed, wash basket 114 can be drained, e.g., by drain pump assembly 130. Laundry articles can then be rinsed by again adding fluid to wash basket 114 depending on the specifics of the cleaning cycle selected by a user. The impeller or agitation element 132 may again provide agitation within wash basket 114. One or more spin cycles may also be used as part of the cleaning process. In particular, a spin cycle may be applied after the wash cycle and/or after the rinse cycle in order to wring wash fluid from the articles being washed. During a spin cycle, wash basket 114 is rotated at relatively high speeds to help wring fluid from the laundry articles through perforations 126. During or prior to the spin cycle, drain pump assembly 130 may operate to discharge wash fluid from wash tub 108, e.g., to an external drain. After articles disposed in wash basket 114 are cleaned and/or washed, the user can remove the articles from wash basket 114, e.g., by reaching into wash basket 114 through opening 116.

While described in the context of a specific embodiment of vertical axis washing machine appliance 100, using the teachings disclosed herein it will be understood that vertical axis washing machine appliance 100 is provided by way of example only. Other washing machine appliances having different configurations, different appearances, and/or different features may also be utilized with the present subject matter as well, e.g., horizontal axis washing machine appliances. In addition, aspects of the present subject matter may be utilized in a combination washer/dryer appliance.

Now that the construction of washing machine appliance 100 and the configuration of controller 156 according to exemplary embodiments have been presented, an exemplary method 200 of draining wash fluid from a top load washing machine appliance will be described. Although the discussion below refers to the exemplary method 200 of operating washing machine appliance 100, one skilled in the art will appreciate that the exemplary method 200 is applicable to the operation of a variety of other washing machine appliances, such as horizontal axis washing machine appliances. In exemplary embodiments, the various method steps as disclosed herein may be performed by controller 156 or a separate, dedicated controller.

Figure 4:
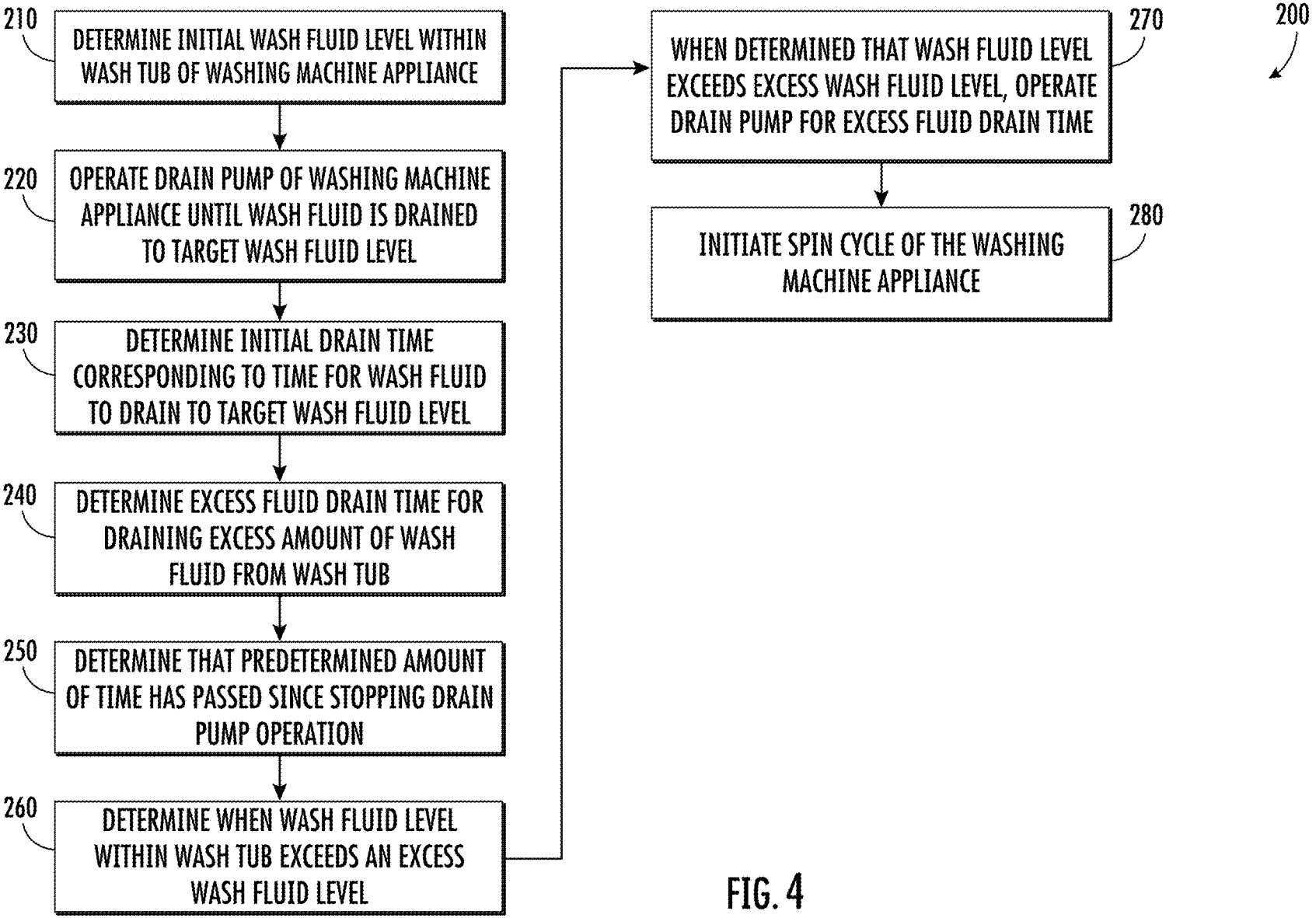
FIG. 4 illustrates a method for draining wash fluid from a washing machine appliance in accordance with one embodiment of the present disclosure.

Referring now to FIG. 4, method 200 includes, at step 210, determining, with a controller, an initial wash fluid level within a wash tub of a washing machine appliance. In this regard, after washing operations in which the wash tub 108 is filled with wash fluid for washing laundry items and prior to draining the wash fluid from the wash tub 108, the controller 156 may determine an initial wash fluid level or wash fluid height of the wash fluid within the wash tub 108 of the washing machine appliance 100. For example, the controller 156 may receive a signal indicative of the initial wash fluid level within the wash tub 108 from the pressure sensor 170 and determine the initial wash fluid level within the wash tub 108 based on the received pressure sensor signal. As will be described below, the initial wash fluid level may be used to determine an excess fluid drain time for draining excess wash fluid within the wash tub 108 caused by wash fluid backflow from the drain hose 135 and/or dripping of wash fluid from wet laundry items after the wash tub 108 has initially been drained.

Additionally, step 220 of method 200 includes operating a drain pump of a washing machine appliance until wash fluid is drained to a target wash fluid level. In this regard, the controller 156 may operate the drain pump 131 of the washing machine appliance 100 until the wash fluid within the wash tub 108 drains from the initial wash fluid level to the target wash fluid level and stop operation of the drain pump 131 to stop draining once the wash fluid level has reached the target wash fluid level. Furthermore, prior to stopping operation of the drain pump 131, the controller 156 may receive a signal indicative of the wash fluid level from the pressure sensor 170 and determine that the wash fluid level has reached the target wash fluid level from the based on the received pressure sensor signal and, thus stop operation of the drain pump 131. Moreover, the target wash fluid level is less than the initial wash fluid level and may correspond to a wash fluid level to drain to in preparation for the spin cycle of the washing machine appliance 100. For example, in one embodiment, the target wash fluid level may correspond to a height of one-tenth of an inch from the bottom of the wash tub 108. Additionally, the target wash fluid level may correspond to a second target wash fluid level lesser than a first target wash fluid level. As will be described below, the first and second target wash fluid levels may be used as benchmarks for timing the draining operations to be used in determining the excess fluid drain time. More than one target wash fluid level may be used to determine the excess fluid drain time because the drain time may not be constant. As such, timing the draining to the first target wash fluid level and additionally timing the draining from the first target wash fluid level to the second target wash fluid level may be used to provide a more accurate excess fluid drain time than if a single drain time was used.

Furthermore, step 230 of method 200 includes determining an initial drain time corresponding to a time for the wash fluid to drain to the target wash fluid level. In this regard, the controller 156 may start a timer when the drain pump 131 is operated to begin draining the wash fluid and stop the timer when the wash fluid has drained to the target wash fluid level and determine the initial drain time from the start of the timer to the stop of the timer. In some embodiments, determining the initial drain time may correspond to the controller 156 determining a first initial drain time for the wash fluid to drain from the initial wash fluid level to the first target wash fluid level. As such, the first target wash fluid level may be less than the initial wash fluid level and greater than the second wash fluid level. For example, in one embodiment, the initial wash fluid level may be two inches from the bottom of the wash tub 108 and the first wash fluid level may be one inch from the bottom of the wash tub 108. Thereafter, when determining the initial drain time, the controller 156 may determine a second initial drain time for the wash fluid to drain from the first target wash fluid level to the second target wash fluid level. For example, in one embodiment, the second target wash fluid level may correspond to one-tenth of inch from the bottom of the wash tub 108.

Notably, after wash fluid has been drained from a wash tub, excess wash fluid, such as wash fluid backflow from a drain hose and/or wash fluid drip from wet laundry items, may accumulate within the wash tub. Such excess wash fluid, when above certain wash fluid levels, may lead to irregularities during the spin cycle of a washing machine appliance, such as an uneven distribution of weight. An uneven distribution of weight of a washing machine appliance may cause excessive displacement of the tub and basket. In minor cases, a slight imbalance may cause vibration or noise. In extreme cases, the tub may contact the cabinet of the appliance. These impacts or "cabinet strikes" are noisy and can cause the washing machine appliance to "walk" on the floor. Over time, the impacts can cause damage to the appliance. Such uneven weight distributions during the spin cycle may be caused by excess wash fluid remaining within the tub after the drain cycle is completed.

In this respect, step 240 of method 200 includes determining an excess fluid drain time for draining an excess amount of wash fluid from the wash tub. In this respect, the controller 156 may determine the excess fluid drain time. According to an example embodiment, the excess fluid drain time may be determined by the controller 156 as shown below with reference to Equation 1. In this regard, $C_1$, $C_2$, $C_3$, $C_4$, and $C_5$ may be fixed coefficients determined empirically or in any other manner. The variable $fl_i$ may refer generally to the initial wash fluid level as described above, the variable $dt_{i1}$ may refer generally to the first initial drain time as described above, and the variable $dt_{i2}$ may refer generally to the second initial drain time as described above. Although exemplary parameters are shown in the regression equation below, it should be appreciated that aspects of the present subject matter may further include other variables.

$$\text{Excess Fluid Drain Time}=C_1+C_2 \cdot fl_i+C_3 \cdot dt_{i1}+C_4 \cdot dt_{i2}+C_5 \cdot dt_{i1} \cdot dt_{i2} \quad \text{Equation 1}$$

In general, Equation 1 is provided above as an example of one methodology for determining the excess fluid drain time for an exemplary washing machine appliance. However, it should be appreciated that these equations may be modified while remaining within the scope of the present subject matter. For example, other variables may be used, the coefficient values may be modified based on empirical data or studies, etc. In addition, it should be appreciated that these relationships may be embodied in any other suitable form, such as other predetermined regression equations, a predetermined lookup table, or a predetermined mathematical relationship.

Moreover, step 250 of method 200 includes after operating the drain pump, determining that a predetermined amount of time has passed since stopping the operation of the drain pump. In this regard, controller 156 may start a timer for a predetermined amount of time, e.g., 30 seconds, to allow any excess fluid to return to the wash tub 108 before determining whether draining the excess wash fluid is needed.

Additionally, step 260 of method 200 includes determining when the wash fluid level within the wash tub exceeds an excess wash fluid level after the predetermined amount of time has passed. In this regard, the controller 156 may determine when the wash fluid level within the wash tub 108 exceeds an excess wash fluid level after the predetermined amount of time has passed. For example, the controller 156 may receive a signal indicative of the wash fluid level within the wash tub 108 from the pressure sensor 170 after the predetermined amount of time has passed and determine when the wash fluid level exceeds the excess wash fluid level based on the received pressure sensor signal. The excess wash fluid level may correspond to a predetermined excess wash fluid level above which wash fluid within the wash tub 108 may negatively affect the spin cycle if the wash fluid were not drained again. As such, the excess wash fluid level may exceed the second target wash fluid level.

Furthermore, step 270 of method 200 includes when determined that the wash fluid level exceeds the excess wash fluid level, operating the drain pump for an excess fluid drain time after the predetermined amount of time has passed to drain the excess amount of the wash fluid from the wash tub. In this regard, when determined that the wash fluid level exceeds the excess wash fluid level, the controller 156 may operate the drain pump 131 for the excess fluid drain time after the predetermined amount of time has passed to drain the excess amount of the wash fluid from the wash tub 108.

Moreover, step 280 of method 200 includes initiating a spin cycle of the washing machine appliance. In this regard, when the controller 156 determined that the wash fluid level does not exceed the excess wash fluid level or, alternatively, when the drain pump 131 has been operated for the excess fluid drain time, the controller 156 may initiate the spin cycle of the washing machine appliance 100.

As explained herein, aspects of the present subject matter are generally directed to a method for draining wash fluid from a top load washing machine appliance. The method includes determining an excess fluid drain time for operating the drain pump to drain excess fluid within the wash tub due to things such as backflow from the drain hose, wash fluid drip from wet laundry items, etc. The excess fluid drain time may be determined by a controller of the washing machine appliance using a regression equation, mathematical formula, etc. with and initial wash fluid level and initial drain times to drain to target wash fluid levels within the wash tub as inputs. Draining excess wash fluid from the wash tub for the excess fluid drain time reduces out-of-balance conditions of the rotating laundry basket of the washing machine appliance due to the weight of the excess wash fluid and other negative impacts.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A washing machine appliance defining a vertical direction, a lateral direction, and a transverse direction, the washing machine appliance comprising:

a wash tub positioned within a cabinet;

a wash basket rotatably mounted within the wash tub and defining a wash chamber configured for receiving a load of clothes;

a drain pump fluidly coupled to the wash tub for selectively draining wash fluid from the wash tub;

a drain hose fluidly coupled to the drain pump for draining the wash fluid from the wash tub; and a controller operably coupled to the drain pump, the controller configured to:

operate the drain pump until the wash fluid is drained to a target wash fluid level;

after operating the drain pump, determine that a predetermined amount of time has passed since stopping the operation of the drain pump;

after the predetermined amount of time has passed, determine when a wash fluid level within the wash tub exceeds an excess wash fluid level; and when determined that the wash fluid level exceeds the excess wash fluid level, operate the drain pump for an excess fluid drain time to drain the excess amount of the wash fluid from the wash tub.

2. The washing machine appliance of claim 1, wherein:

the excess fluid drain time is determined using a predetermined regression equation, a predetermined lookup table, or a predetermined mathematical relationship.

3. The washing machine appliance of claim 1, wherein:

the target wash fluid level corresponds to a second target wash fluid level; and the controller is further configured to:

determine a first initial drain time corresponding to a time for the wash fluid to drain to a first target wash fluid level greater than the second target wash fluid level.

4. The washing machine appliance of claim 3, wherein the controller is further configured to:

determine a second initial drain time corresponding to a time for the wash fluid to drain from the first target wash fluid level to the second target wash fluid level.

5. The washing machine appliance of claim 4, wherein, prior to operating the drain pump, the controller is further configured to:

determine an initial wash fluid level within the wash tub.

6. The washing machine appliance of claim 5, wherein:

the controller is further configured to operate the drain pump for the excess fluid drain time after the predetermined amount of time has passed to drain the excess amount of the wash fluid from the wash tub; and the excess fluid drain time is determined based at least in part on a predetermined regression equation with the initial wash fluid level, the first initial drain time, and the second initial drain time as inputs.

7. The washing machine appliance of claim 1, wherein the controller is further configured to:

initiate a spin cycle of the washing machine appliance when determined that wash fluid level does not exceed the excess wash fluid level.

8. The washing machine appliance of claim 1, further comprising:

a pressure sensor configured to generate a signal indicative of a wash fluid level within the wash tub, the pressure sensor operatively coupled to the controller.

9. The washing machine appliance of claim 1, wherein the wash basket is rotatably mounted within the wash tub for rotation about an axis parallel to the vertical direction.

10. A method for draining wash fluid from a washing machine appliance defining a vertical direction, a lateral direction, and a transverse direction, the washing machine appliance including a wash tub positioned within a cabinet, a wash basket rotatably mounted within the wash tub and defining a wash chamber configured for receiving a load of clothes, a drain pump fluidly coupled to the wash tub for selectively draining wash fluid from the wash tub, and a drain hose fluidly coupled to the drain pump for draining the wash fluid from the wash tub, the method comprising:

operating, with a controller, the drain pump until the wash fluid is drained to a target wash fluid level;

after operating the drain pump, determining, with the controller, that a predetermined amount of time has passed since stopping the operation of the drain pump;

determining, with the controller, when a wash fluid level within the wash tub exceeds an excess wash fluid level after the predetermined amount of time has passed; and when determined that the wash fluid level exceeds the excess wash fluid level, operating, with the controller, the drain pump for an excess fluid drain time after the predetermined amount of time has passed to drain the excess amount of the wash fluid from the wash tub.

11. The method of claim 10, further comprising:

determining, with the controller, the excess fluid drain time using a predetermined regression equation, a predetermined lookup table, or a predetermined mathematical relationship.

12. The method of claim 10, wherein the target wash fluid level corresponds to a second target wash fluid level, the method further comprising:

determining, with the controller, a first initial drain time corresponding to a time for the wash fluid to drain to a first target wash fluid level greater than the second target wash fluid level.

13. The method of claim 12, further comprising:

determining, with the controller, a second initial drain time corresponding to a time for the wash fluid to drain from the first target wash fluid level to the second target wash fluid level.

14. The method of claim 13, further comprising:

prior to operating the drain pump, determining, with the controller, an initial wash fluid level within the wash tub.

15. The method of claim 14, further comprising:

operating, with the controller, the drain pump for the excess fluid drain time after the predetermined amount of time has passed to drain the excess amount of the wash fluid from the wash tub; and determining, with the controller, the excess fluid drain time based at least in part on a predetermined regression equation with the initial wash fluid level, the first initial drain time, and the second initial drain time as inputs.

16. The method of claim 10, further comprising:

initiating, with the controller, a spin cycle of the washing machine appliance when determined that wash fluid level does not exceed the excess wash fluid level.

* * * * *